United States Patent [19]

Becker

[11] 4,156,623

[45] May 29, 1979

[54] METHOD FOR INCREASING THE EFFECTIVENESS OF A MAGNETIC FIELD FOR MAGNETIZING COBALT-RARE EARTH ALLOY

[75] Inventor: Joseph J. Becker, Schenectady, N.Y.

[73] Assignee: General Electric Company, Schenectady, N.Y.

[21] Appl. No.: 668,585

[22] Filed: Mar. 19, 1976

Related U.S. Application Data

[63] Continuation-in-part of Ser. No. 527,946, Nov. 29, 1974, abandoned.

[51] Int. Cl.[2] ..... H01F 1/02

[52] U.S. Cl. ..... 148/103; 148/31.57; 148/105; 148/108

[58] Field of Search ..... 148/103, 105, 108, 31.57

[56] References Cited

U.S. PATENT DOCUMENTS

| | | | |
|---|---|---|---|
| 3,802,935 | 4/1974 | Martin et al. | 148/103 |
| 3,849,213 | 11/1974 | Baermann | 148/108 |
| 3,891,476 | 6/1975 | Naastepad | 148/103 |

OTHER PUBLICATIONS

Bozorth, R; *Ferromagnetism;* New York, 1951, pp. 117–119, (71–176 and 389–390.

*Primary Examiner*—I. Dewayne Rutledge
*Assistant Examiner*—John P. Sheehan
*Attorney, Agent, or Firm*—Jane M. Binkowski; Joseph T. Cohen; Charles T. Watts

[57] ABSTRACT

A cobalt-rare earth alloy sintered product is substantially magnetized by heating or cooling it to a temperature at which its intrinsic coercive force $H_{ci}$ is significantly lower than at room temperature, applying a relatively small magnetizing field to it at such temperature and cooling or warming it in the magnetizing field to room temperature.

2 Claims, 1 Drawing Figure

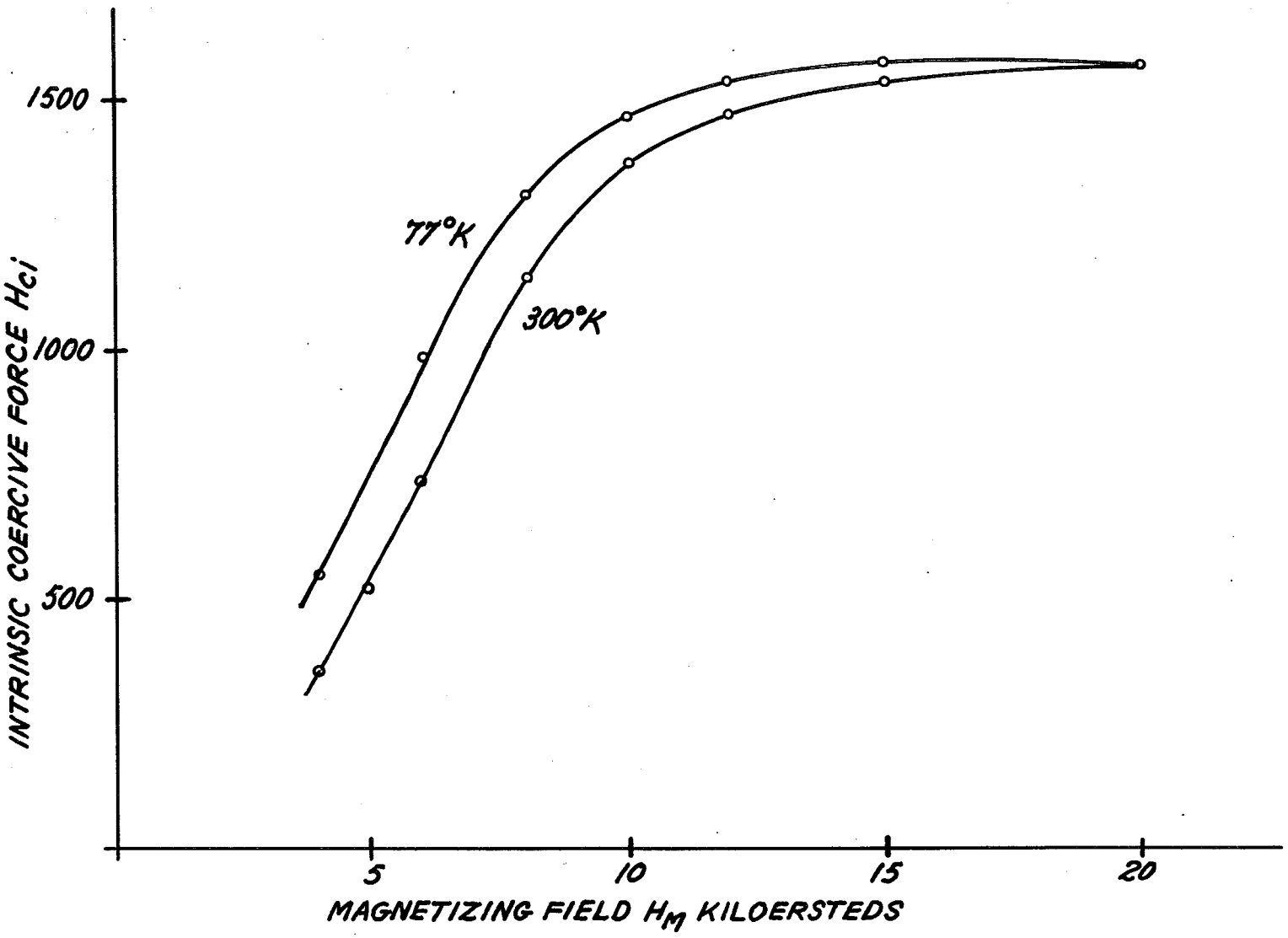
INTRINSIC COERCIVE FORCE $H_{ci}$
1500
1000
500
77°K
300°K
5
10
15
20
MAGNETIZING FIELD $H_M$ KILOERSTEDS

METHOD FOR INCREASING THE EFFECTIVENESS OF A MAGNETIC FIELD FOR MAGNETIZING COBALT-RARE EARTH ALLOY

This is a continuation-in-part of copending Ser. No. 527,946 filed Nov. 29, 1974, now abandoned, in the name of Joseph J. Becker and assigned to the assignee hereof.

The present invention relates generally to the art of cobalt-rare earth alloy permanent magnets. In one aspect, it relates to substantially increasing the effectiveness of a relatively small magnetic field in magnetizing a cobalt-rare earth alloy to produce a permanent magnet.

Permanent magnets, i.e., "hard" magnetic materials such as the cobalt-rare earth alloys, are of technological importance because they can maintain a high constant magnetic flux in the absence of an exciting magnetic field or electrical current to bring about such a field.

Within the past few years a new class of materials for making permanent magnets has been developed, based on cobalt and rare-earth elements. The improvement over prior art materials is so great that the cobalt-rare-earth magnets stand in a class by themselves. In terms of their resistance to demagnetization the new materials are from 20 to 50 times superior to conventional magnets of the Alnico type, and their magnetic energy is from two to six times greater. Since the more powerful the magnet for a given size is the smaller it can be for a given job, the cobalt-rare-earth alloy magnets have applications for which prior art materials cannot even be considered.

The high intrinsic coercive force $H_{ci}$ of the cobalt-rare-earth alloys makes it difficult to magnetize them by normal means. For example, magnetization of Alnico or BaO ferrite is readily accomplished by a 2500–3000 oersted field; however, such a field is too low for most of the cobalt-rare earth alloys where the inherent intrinsic coercive force $H_{ci}$ value may exceed 15,000 oersteds at room temperature. As a result large amounts of energy and complex equipment such as superconducting coils which are usually not available are required to produce magnetizing fields sufficiently high for example, of the order of 50,000 oersteds, to effectively magnetize the cobalt-rare earth alloys.

In accordance with the present invention, the effective magnetization of a cobalt-rare earth alloy by a relatively small magnetizing field is increased substantially. Specifically, in the present process, the intrinsic coercive force $H_{ci}$ of a cobalt-rare earth alloy is temporarily reduced by varying the temperature of the alloy to increase the effect of a given magnetizing field.

Those skilled in the art will gain a further and better understanding of the present invention from the detailed description set forth below, considered in conjunction with the accompanying FIGURE which forms a part of the specification where the curve marked 77° K. produced in accordance with the present process shows a resistance to demagnetization significantly higher than that produced by utilizing the same given magnetizing field at room temperature 300° K.

Briefly stated, the present process is directed to substantially magnetizing a cobalt-rare earth alloy sintered product wherein the pores are substantially non-interconnecting having a density ranging from about 87 to 100 percent of theoretical and consisting essentially of compacted particulate alloy consisting essentially of a composition ranging from a single solid $Co_5R$ phase to a $Co_5R$ phase and a second solid CoR phase in an amount up to about 30 percent by weight of said product and richer in rare earth metal content than said $Co_5R$ phase, where R is a rare earth metal or metals, said product having an intrinsic coercive force $H_{ci}$ is excess of 5000 oersteds.

In one embodiment of the invention such a sintered product is characterized by a significant lowering of intrinsic coercive force $H_{ci}$ at an elevated temperature ranging from 100° C. to about 400° C. and always at least 100° C. below its Curie temperature and the process comprises placing said sintered product at said elevated temperature at which its intrinsic coercive force $H_{ci}$ is significantly lower than at room temperature without significantly deteriorating its magnetic properties, applying to said sintered product at said elevated temperature a magnetizing field ranging from 500 oersteds to about 5000 oersteds along its easy axis of magnetization and cooling said sintered product in said magnetizing field to about room temperature. The rate of cooling of the magnetized product is not critical and can be as fast as desirable without cracking the product.

tain permanent magnet type cobalt-rare earth alloys, for example, $Co_5Pr$, decreases significantly as the temperature of the alloy is lowered from room temperature. For such alloys, the present invention comprises cooling the sintered product to a depressed temperature at which its intrinsic coercive force is significantly lower than at room temperature, and generally, such a temperature ranges from −25° C. to that of liquid $N_2$, e.g., about −200° C. The sintered product can be cooled by a number of techniques which do not deteriorate its magnetic properties to any significant extent such as, for example, by immersing it in liquid nitrogen. At the depressed temperature a magnetizing field ranging from 500 oersteds to 20,000 oersteds is applied to the sintered product along its easy axis of magnetization and the product is warmed in air in the magnetizing field to room temperature. The rate at which the sintered product warms up to room temperature in the magnetizing field is not critical. In the preferred embodiment and for most applications, the magnetizing field ranges from 500 oersteds to 10,000 oersteds.

The present process is particularly useful for cobalt-rare earth alloy magnets having at room temperature an intrinsic coercive force $H_{ci}$ in excess of 5000 oersteds. Specifically, when a permanent magnet material is magnetized, a magnetization value of $4\pi M$ gauss is established therein. The shape of the magnet imposes a self-demagnetizing field of H oersteds. Together, these properties, $4\pi M$ and the self-demagnetizing field H equal the operating flux density or open circuit induction $B_o$ which is also measured in gauss. The intrinsic coercive force $H_{ci}$ of the permanent magnet is the value of the external demagnetizing field which must be applied to the magnet at room temperature to reduce its magnetization $4\pi M$ to zero. $H_{ci}$ is a measure of a permanent magnet's resistance to demagnetization.

The present invention is directed to cobalt-rare earth alloy magnets having an intrinsic coercive force in excess of 5000 oersteds. Such magnets are usually sintered cobalt-rare earth alloy products which may be prepared by a number of techniques. Briefly, the cobalt-rare earth alloy is formed and converted to particulate form. The particles are compressed into a green body which is then sintered in a substantially inert atmosphere to produce a sintered body of the desired density.

Cobalt-rare earth alloys exist in a variety of phases, but the $Co_5R$ single phase compound or alloy (in each occurrence R designates a rare earth metal) has exhibited the best magnetic properties, and generally, sintered products composed of the $Co_5R$ phase or containing the $Co_5R$ phase in at least a significant amount have produced the best permanent magnets.

Specifically, the present invention is particularly useful for the sintered cobalt-rare earth permanent magnets disclosed in U.S. Pat. No. 3,655,464, U.S. Pat. Nos. 3,655,463 and 3,695,945, all of which are assigned to the assignee hereof, and all of which by reference are made part of the disclosure of the present application.

Each of the aforementioned patents discloses a process for preparing novel sintered cobalt-rare earth intermetallic products which can be magnetized to form magnets having improved permanent magnet properties.

Briefly stated, in U.S. Pat. No. 3,655,464 a particulate mixture of a base CoR alloy and an additive CoR alloy, where R is a rare earth metal or metals is sintered to produce a product having a composition lying outside the $Co_5R$ single phase on the rare earth richer side. Specifically, the base alloy is one which at sintering temperature exists as a solid $Co_5R$ intermetallic single phase. Since the $Co_5R$ single phase may vary in composition, the base alloy may vary in composition which can be determined from the phase diagram for the particular cobalt-rare earth system, or empirically. The additive cobalt-rare earth alloy is richer in rare earth metal than the base alloy and at sintering temperature it is at least partly in liquid form and thus increases the sintering rate. The additive alloy may vary in composition and can be determined from the phase diagram for the particular cobalt-rare earth system or it can be determined empirically.

The base and additive alloys, in particulate form, are each used in an amount to form a mixture which has a cobalt and rare earth metal content substantially corresponding to that of the final desired sintered product. The additive alloy should be used in an amount sufficient to promote sintering, and generally, should be used in an amount of at least 0.5 percent by weight of the base-additive alloy mixture. The particulate mixture is compressed into a green body of the desired size and density. Preferably, the particles are magnetically aligned along their easy axis prior to or during compression since the greater their magnetic alignment, the better are the resulting magnetic properties.

The green body is sintered in a substantially inert atmosphere to produce a sintered body of desired density. Preferably, the green body is sintered to produce a sintered body wherein the pores are substantially non-interconnecting, which generally is a sintered body having a density of at least about 87 percent of theoretical. Such non-interconnectivity stabilizes the permanent magnet properties of the product because the interior of the sintered product or magnet is protected against exposure to the ambient atmosphere.

Sintering temperature depends largely on the particular cobalt-rare earth intermetallic material to be sintered, but it must be sufficiently high to coalesce the component particles. Preferably, sintering is carried out so that the pores in the sintered product are substantially non-interconnecting. For cobalt-samarium alloys, as well as most cobalt-rare earth alloys, a sintering temperature ranging from about 950° C. to about 1200° C. is suitable. Specifically, for cobalt-samarium alloys a sintering temperature of 1100° C. is particularly satisfactory.

The density of the sintered product may vary. The particular density depends largely on the particular permanent magnet properties desired. Preferably, to obtain a product with substantially stable permanent magnet properties, the density of the sintered product should be one wherein the pores are substantially non-interconnecting and this occurs usually at a density or packing of about 87 percent.

The procedure for forming sintered products disclosed in U.S. Pat. Nos. 3,655,463 is substantially the same as that disclosed in U.S. Pat. No. 3,655,464 except that an additive Co-R alloy which is solid at sintering temperature and which is richer in rare earth metal than the base alloy is used.

The procedure for forming the sintered products disclosed in U.S. Pat. No. 3,695,945 is substantially the same as that disclosed in U.S. Pat. No. 3,655,464 except that a cobalt-rare earth metal alloy of proper composition is initially formed.

When used in the present process, the sintered products of the referred to U.S. patents contain a major amount of the $Co_5R$ solid intermetallic phase, generally at least about 70 percent by weight of the product, and a second solid CoR intermetallic phase which is richer in rare earth metal content than the $Co_5R$ phase and which is present in an amount of up to about 30 percent by weight of the product. Traces of other cobalt-rare earth intermetallic phases, in most instances less than one percent by weight of the product, may also be present.

In addition, U.S. Pat. No. 3,684,593 assigned to the assignee hereof, is, by reference, made part of the disclosure of the present application. Briefly stated, in U.S. Pat. No. 3,684,593 there is disclosed a process for preparing heat-aged novel sintered cobalt-rare earth intermetallic products by providing a sintered cobalt-rare earth intermetallic product ranging in composition from a single solid $Co_5R$ phase to that composed of $Co_5R$ and a second phase of solid CoR in an amount of up to about 30 percent by weight of the product and richer in rare earth metal content than said $Co_5R$, and heat-aging said product at an aging temperature within 400° C. below the temperature at which it was sintered to precipitate CoR phase richer in rare earth metal content than said $Co_5R$ in an amount sufficient to increase intrinsic and/or normal coercive force of said product by at least 10 percent, where R is a rare earth metal or metals. Heat-aging is carried out in an atmosphere such as argon in which the material is substantially inert. The precipitated CoR phase is generally present in an amount ranging from about 1 to 15 percent by weight of the product. The present invention is particularly useful for these heat-aged sintered products.

The rare earth metals useful in preparing the cobalt-rare earth alloys and intermetallic compounds used in forming the sintered products are the 15 elements of the lanthanide series having atomic numbers 57 to 71 inclusive. The element yttrium (atomic number 39) is commonly included in this group of metals and, in this specification, is considered a rare earth metal. A plurality of rare earth metals can also be used to form the present desired cobalt-rare earth alloys or intermetallic compounds which, for example may be ternary, quartenary or which may contain an even greater number of rare earth metals as desired.

Representative of the cobalt-rare earth alloys useful in forming the sintered products are cobalt-cerium, cobalt-praseodymium, cobalt-neodymium, cobalt-samarium, cobalt-europium, cobalt-gadolinium, cobalt-terbium, cobalt-dysprosium, cobalt-holmium, cobalt-erbium, cobalt-thulium, cobalt-ytterbium, cobalt-lutecium, colbalt-yttrium, cobalt-lanthanum and cobalt-mischmetal. Mischmetal is the most common alloy of the rare earth metals which contains the metals in the approximate ratio in which they occur in their most common naturally occurring ores. Examples of specific ternary alloys include cobalt-samarium-mischmetal, cobalt-cerium-praseodymium, cobalt-yttrium-praseodymium, and cobalt-praseodymium-mischmetal.

In the present process the elevated temperature to which the sintered product is heated is always at least 100° C. below its Curie temperature. The Curie temperature is that temperature above which the sintered product loses its ferromagnetic properties, and it is a measure of the magnet's resistance to high temperatures.

The Curie temperature for most materials is available in the art. Specifically, for the $Co_5Sm$ intermetallic compound it is 725° C., for $Co_5Pr$ it is 610° C., for $Co_5La$ it is 570° C., for $Co_5Gd$ it is 735° C., for $Co_5$-Mischmetal it is 500° C. and for $Co_5Ce$ it is 375° C.

The Curie temperature can also be determined empirically by heating the product to successively higher temperatures, and applying a magnetizing field to the product along its easy axis at such temperatures until a temperature is reached where it exhibits no magnetic properties.

As a practical matter it is preferred to apply the magnetizing field to the sintered product as it is cooling after the sintering or heat-aging steps. Alternatively, the sintered product can initially be at room temperature and heated to the desired elevated temperature at which the magnetizing field is applied and then cooled in the field to about room temperature.

In the present process, the magnetizing field can be applied to the sintered product at the desired elevated temperature in an atmosphere in which it is substantially inert such as argon but usually, it can be applied in air without significant deterioration of its magnetic properties since the period of time it is at such elevated temperature is not critical.

In carrying out the present process, the particular elevated or depressed temperature to which the sintered product is heated or cooled, respectively, depends largely on the extent of the accompanying decrease in intrinsic coercive force. Also, the strength of the magnetizing field applied at such elevated or depressed temperature depends on the value of the intrinsic coercive force at that temperature as well as the particular magnetic properties desired in the end product magnet. For example, cooling a cobalt-rare earth alloy sintered product in a magnetizing field of 3000 oersteds from a temperature of 300° C. to room temperature can produce a magnet having magnetic properties equivalent to one cooled in a magnetizing field of 5000 oersteds from a temperature of 200° C. to room temperature. In the present invention, the sintered product need only be brought up to the desired elevated temperature or down to the depressed temperature and the period of time which it is at such temperature is not critical.

In the present process a satisfactory elevated or depressed temperature for a given magnetizing field for a particular product can be determined empirically, as for example, by carrying out a series of runs by cooling or warming the sintered product in a given magnetizing field from successively higher elevated or successively lower depressed temperatures to room temperature and determining the open circuit flux or induction $B_o$ of each resulting magnetized sintered product at room temperature.

The magnetizing field is always applied along the easy axis of magnetization of the sintered product. Preferably, to save energy, it is applied initially at the elevated or depressed temperature and maintained during cooling or warming to room temperature. However, the same results are achieved by applying the magnetizing field to the product at room temperature and maintaining it during heating or cooling to elevated or depressed temperatures as well as during cooling and warming to room temperature.

The process of the present invention does not produce any significant change in the structure or composition of the product.

As a result of this invention, cobalt-rare earth alloy sintered products are magnetized by low energy means without significant deterioration of their permanent magnet properties. The magnetizing fields used in the present process can be provided, for example, by means of an electromagnet.

The invention is further illustrated by the following examples in which magnetizing fields were always applied along the easy axis of magnetization.

EXAMPLE 1

A sintered body having a density of about 95% and consisting essentially of a major amount of a $Co_5Sm$ phase and a minor amount of $Co_7Sm_2$ phase was used and was prepared substantially as set forth in U.S. Pat. No. 3,655,464. The body was in the form of a cylinder about 1⅛ inches long and 5/16 inch in diameter.

The same cylinder was used in all of the runs of Table I. Specifically, in Table I, the open circuit induction $B_o$ was measured in the conventional way by observing the deflection of the pointer of an integrating fluxmeter when the magnetized cylinder was removed from a search coil. In each run the procedure comprised first reducing the open-circuit induction $B_o$ to zero. This was done by applying a magnetic field opposite to any flux or induction the cylinder may have had, removing the field and then measuring the remaining $B_o$, applying a larger magnetic field to the cylinder and repeating the measurement until $B_o$ was zero. Then, each measurement in Table I consisted of beginning from this initial condition.

For comparison, one series of measurements in Table I was made after application of the given magnetizing field at room temperature. In each of the remaining series of measurements, the cylinder, with its $B_o$ at zero, was placed in a pre-heated air oven, heated to the given temperature, then placed quickly in the magnetizing field so that any loss in temperature was insignificant. The sample was cooled in air using an air blower to hasten cooling to room temperature in the field, then it was removed from the field and the resulting $B_o$ was measured. Then the $B_o$ was reduced to zero again before the next measurement.

The results are shown in Table I.

TABLE I

| Run No. | Magnetizing Field Oersteds | Temperature °C. Maintained at Room Temperature | From 200° C. To Room Temperature | From 300° C. To Room Temperature | From 400° C. To Room Temperature |
|---|---|---|---|---|---|
| 1 | 3,000 | 15.6 | 37.6 | 45.5 | 49.8 |
| 2 | 5,000 | 23.2 | 45.2 | 52.8 | 53.2 |
| 3 | 10,000 | 42.0 | — | — | — |
| 4 | 15,000 | 47.4 | — | — | — |
| 5 | 20,000 | 48.0 | — | — | — |
| | | Fluxmeter Deflection Of Magnetized Product At Room Temperature Proportional To Open Circuit Flux $B_o$ | | | |

The present process is illustrated by Table I. Specifically, a comparison of Run Nos. 1 and 5 shows that cooling the sample from 400° C. to room temperature in a magnetizing field of 3000 oersteds was more effective than magnetizing it initially at room temperature in a magnetizing field of 20,000 oersteds.

EXAMPLE 2

In this example a powder of $Co_5Pr$ alloy having an average particle size of 8 microns was used. The powder was introduced into a body of molten paraffin wax in a small glass tube and the wax was cooled in an aligning magnetic field of 20,000 oersteds until it solidified. The sample was then demagnetized using reverse fields to reduce $B_o$ to zero by substantially the same technique disclosed in Example 1. Then each measurement consisted of beginning from this initial condition. This sample was used in each run shown in the accompanying FIGURE. As shown in the FIGURE, two series of measurements were made after application of the given magnetizing field which ranged from 4000 oersteds to 20,000 oersteds. One series of measurements was made after application of the given magnetizing field at room temperature where each resulting magnetized sample was then demagnetized by applying an external demagnetizing field at room temperature which reduced its magnetization to zero, and the value of such external demagnetizing field is shown as intrinsic coercive force $H_{ci}$ in the FIGURE. The curve marked 300° K. shows the intrinsic coercive force $H_{ci}$ as a function of previous magnetizing field $H_m$ applied at room temperature.

The curve marked 77° K. shows the intrinsic coercive force $H_{ci}$ at room temperature measured after a given magnetizing field $H_m$ was applied and the sample then cooled to liquid nitrogen temperature and then warmed back to room temperature in air with the field still on.

A comparison of the curves in the FIGURE shows that a given magnetizing field results in a magnetized product with a larger intrinsic coercive force, and consequently significantly better permanent magnet properties, when the sample is cooled and rewarmed with the magnetizing field on. It is important that the field be on during the time that intrinsic coercive force $H_{ci}$ is increasing, i.e., when the temperature is rising back to room temperature. It is not essential that the magnetizing field $H_m$ be on while the sample is cooling and this was done in this example only for convenience.

In copending U.S. Pat. application, Ser. No. 527,947, now abandoned entitled "Magnetizing Cobalt-Rare Earth Alloy Magnets By Cooling Through The Curie Temperature In A Magnetic Field" filed of even date (Nov. 29, 1974) herewith in the name of Mark G. Benz and assigned to the assignee hereof, and which by reference is made part of the disclosure of the present application, there is disclosed a process for substantially magnetizing a cobalt-rare earth alloy sintered product by applying a relatively small magnetizing field to it at a temperature above its Curie temperature and cooling it in the magnetizing field through the Curie temperature to about room temperature.

What is claimed is:

1. A process for substantially magnetizing a cobalt-rare earth alloy sintered product wherein the pores are substantially non-interconnecting and having a density ranging from about 87 to 100 percent and consisting essentially of compacted particulate alloy consisting essentially of a composition ranging from a single solid $Co_5R$ phase to a $Co_5R$ phase and a second solid CoR phase in an amount up to about 30 percent by weight of said product and richer in rare earth metal content than said $Co_5R$ phase, where R is a rare earth metal or metals, said product having an intrinsic coercive force $H_{ci}$ in excess of 5000 oersteds and characterized by a significant loss in its room temperature intrinsic coercive force $H_{ci}$ at a depressed temperature ranging from −25° C. to −200° C., which comprises cooling said sintered product to a depressed temperature ranging from −25° C. to −200° C. at which its intrinsic coercive force $H_{ci}$ is significantly lower than at room temperature, applying said sintered product at said depressed temperature a magnetizing field ranging from 500 oersteds to 20,000 oersteds substantially along its easy axis of magnetization and warming said sintered product in said magnetizing field to room temperature.

2. A process according to claim 1 wherein R is praseodymium.

* * * * *